US008282452B2

(12) United States Patent
Grigsby et al.

(10) Patent No.: US 8,282,452 B2
(45) Date of Patent: Oct. 9, 2012

(54) ROOF ASSEMBLY FOR AN AIR HANDLER

(75) Inventors: James M. Grigsby, Clarksville, TN (US); Jeffrey C. Marks, Clarksville, TN (US)

(73) Assignee: Trane International Inc., Piscataway, NJ (US)

( * ) Notice: Subject to any disclaimer, the term of this patent is extended or adjusted under 35 U.S.C. 154(b) by 1007 days.

(21) Appl. No.: 12/291,123

(22) Filed: Nov. 6, 2008

(65) Prior Publication Data

US 2010/0112930 A1 May 6, 2010

(51) Int. Cl.
*F24F 7/00* (2006.01)

(52) U.S. Cl. ..... 454/333

(58) Field of Classification Search ..... 248/317, 248/581; 49/463; 220/796–806; 62/77, 62/295, 298; 454/333
See application file for complete search history.

(56) References Cited

U.S. PATENT DOCUMENTS 4,048,811 A * 9/1977 Ito et al. ..... 62/263
4,139,052 A * 2/1979 Lackey ..... 165/59
4,747,505 A 5/1988 Hansen
4,776,484 A * 10/1988 Hansen ..... 220/345.6
5,050,488 A * 9/1991 Beasley ..... 454/333
6,260,374 B1 * 7/2001 Smith et al. ..... 62/298
6,820,952 B2 * 11/2004 Austin et al. ..... 312/326
2007/0290586 A1 * 12/2007 Rosete et al. ..... 312/236

* cited by examiner

*Primary Examiner* — Eric Keasel
*Assistant Examiner* — David Colon Morales
(74) *Attorney, Agent, or Firm* — William O'Driscoll

(57) ABSTRACT

An air handler (or air handler section) includes an enclosure containing various internal HVAC components and a bi-directional alignment system that during factor assembly of the enclosure helps align the enclosure's entire roof to the internal components. To help align the roof in a widthwise direction, a tapered lead-in edge in the upper corners of a block-off panel for an evaporator, filter rack, damper, fan and/or other HVAC component engages a roof rail that runs along the length of the roof. The upper corners of the block-offs also include a landing edge that engages the underside of the roof rail to help support the weight of the roof. Cross rails attached to the underside of the roof and extending along the width of the enclosure include an inclined lead-in flange that engages the upper edge of the various internal HVAC components, thereby helping align the roof in a lengthwise direction.

26 Claims, 4 Drawing Sheets

ROOF ASSEMBLY FOR AN AIR HANDLER

FIELD OF THE INVENTION

The subject invention generally pertains to refrigerant air handling systems and more specifically to a roof assembly for such a system.

BACKGROUND OF RELATED ART

Air handlers or the air handler section of an air conditioning unit for meeting the HVAC (heating, ventilating and air conditioning) needs of a building often comprise a refrigerant or other fluid based system housed within a sheet metal enclosure. The refrigerant system may include one or more compressors, a condenser, an evaporator, fans, filters, dampers, and various other equipment. When serving a large commercial, institutional or industrial building, it is not unusual for an air handler to have an enclosure that is over thirty feet long, twelve feet wide, and eight feet tall.

Such large enclosures can be difficult to assemble in the factory. Installing the massive roof in proper alignment with all the various components inside the enclosure can be particularly challenging, time consuming and potentially hazardous. Fitting the roof to the components underneath it usually involves the use of relatively large, cumbersome fixtures, braces, lifting devices, and multiple workers to assure alignment and fit up. Due to the height of the enclosure, it is also difficult to ergonomically secure the internal components in place and assure proper sealing.

Consequently, there is a need for large air handler enclosures that are quicker, easier and safer to assemble.

SUMMARY OF THE INVENTION

It is an object of the invention to provide an enclosure for an air handler with alignment features that help guide an entire roof onto various components underneath the roof.

Another object of some embodiments is to provide alignment features that help align the roof in two dimensions, lengthwise and widthwise.

Another object of some embodiments is to incorporate a tapered lead-in edge in the upper corners of a block-off for an evaporator, filter rack, damper, fan and/or other HVAC equipment so that the lead-in edge engages a roof rail to help align the roof in a widthwise direction.

Another object of some embodiments is to fasten cross rails to the underside of the roof, wherein the cross rails include an inclined lead-in flange that engages the upper edge of various internal HVAC equipment, thus helping align the roof in a lengthwise direction.

Another object of some embodiments is to install a gasket that not only provides sealing between the underside of the roof and the upper surface of a block-off but also helps fill a generally triangular gap created by the tapered lead-in edge of the block-off.

Another object of some embodiments is to provide lateral structural support for internal components, wherein the cross rails include a vertical flange that mates to various internal components thus reducing the need for mechanical fasteners.

Another object of some embodiments is to provide some vertical clearance between an upper surface of an internal panel and the underside of a roof, thereby providing some vertical "float" between the internal panel and the roof.

One or more of these and/or other objects of the invention are provided by an air handler comprising an enclosure that contains various HVAC components and bi-directional alignment features. During factory assembly, the alignment features help align the enclosure roof to the components in both lengthwise and widthwise directions.

DESCRIPTION OF THE PREFERRED EMBODIMENT

Figure 1:
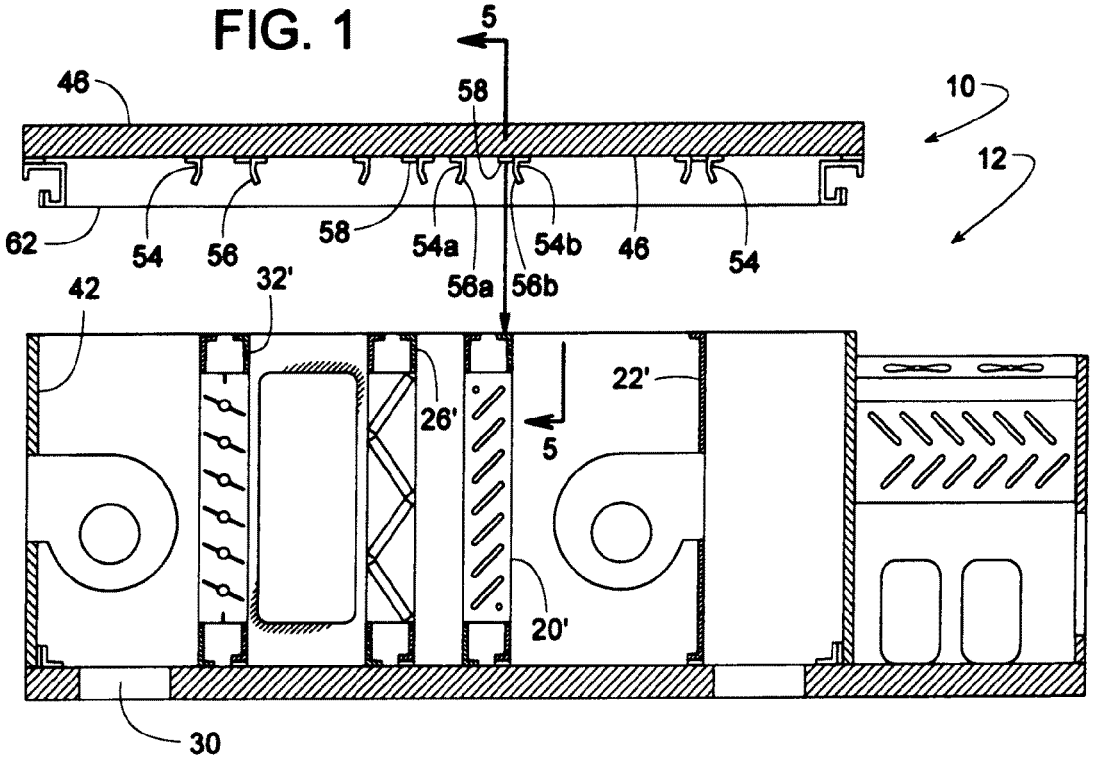
FIG. 1 is a schematic cross-sectional cut-away view of a partially assembled air handler that includes a novel roof alignment system.
Figure 2:
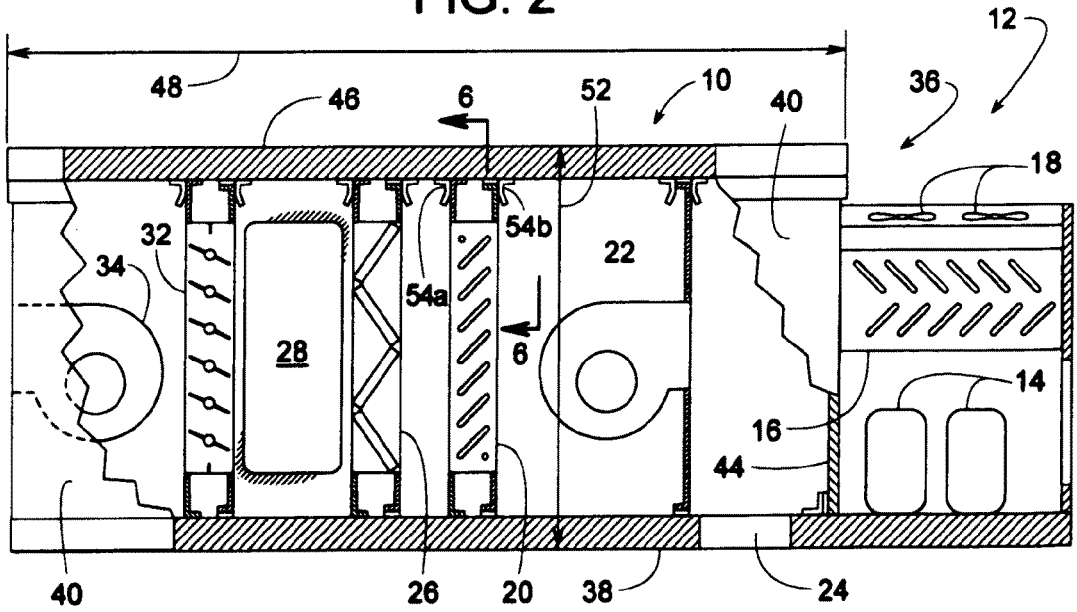
FIG. 2 is a view similar to FIG. 1 but showing the air handler's roof installed.

FIGS. 1-6 illustrate a novel roof assembly 10 for an air handler 12. An air handler is defined herein as any apparatus comprising a roofed enclosure containing various components for providing heated, cooled, or otherwise conditioned air to a room, area or comfort zone of a building. Although the subject invention is being described with reference to the example air handler schematically illustrated in FIG. 2, it should be understood by those of ordinary skill in the art that the invention is readily applicable to various other air handlers having different components with different structural arrangements.

For the illustrated example, air handler 12 comprises one or more compressors 14 for providing compressed refrigerant, a condenser coil heat exchanger 16 for condensing the compressed refrigerant from compressors 14, one or more fans 18 for cooling condenser 16, an evaporator coil heat exchanger 20 (or some other type of heat exchanger containing a fluid) for providing a cooling effect caused by refrigerant expanding as a flow restriction (not shown) conveys the fluid from condenser 16 to evaporator 20, a supply fan 22 that forces air through evaporator 20 to produce cool air that can be supplied to a comfort zone via a supply air outlet 24, a filter rack 26 holding one or more elements for filtering air prior to passing through evaporator 20, a fresh air inlet 28 for receiving outdoor air, a return air inlet 30 for receiving return air from the comfort zone, a damper 32 for creating a certain mixture of return air and outdoor air, and an exhaust fan 34 for discharging a portion of return air.

Many of the aforementioned components of air handler 12 are housed within an enclosure 36 comprising a base 38, a plurality of side panels 40, an end wall 42, a bulkhead wall 44, and a roof 46. Enclosure 36 has an overall length 48, a width 50 (FIG. 6), and a height 52.

Since the active area of some or all of the air handler's internal components might not extend the full width or height of enclosure 36, to prevent airflow from bypassing those components, an internal panel or block-off can be added along the outer periphery of the components. For the illustrated example, evaporator 20 includes block-off extension 20', damper 32 includes block-off extension 32', filter rack 26 includes block-off extension 26', and fan 22 includes block-off extension 22' (also known as a fan board). In some cases, an internal panel or block-off can simply serve as a standalone divider in an enclosure and not necessarily be connected to any active component.

It would not be unusual for an air handler to be thirty feet long, twelve feet wide, and eight feet tall. A unit of such size can be difficult to assemble. Installing the roof in proper alignment with all the various internal HVAC components can be particularly challenging. To address this problem, air handler 12 includes two alignment features that ensure the assembly is properly aligned along both the length 48 and width 50 of enclosure 36.

Figure 3:
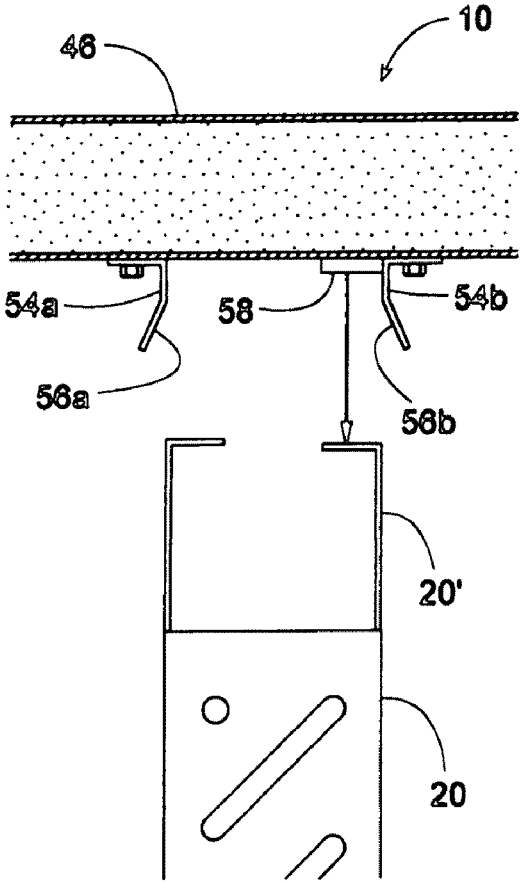
FIG. 3 is an enlarged view of one area of FIG. 1.
Figure 4:
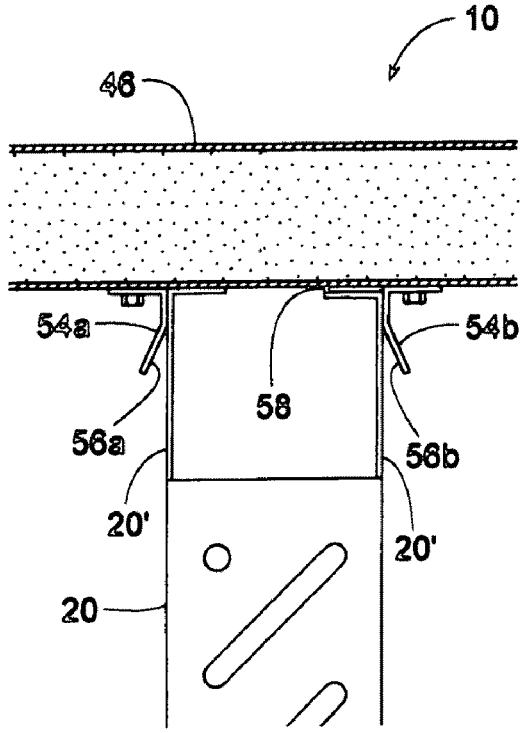
FIG. 4 is similar to FIG. 3 but showing the roof installed.

To align the internal components to roof 46 along length 48, a plurality of cross rails 54 are attached to the underside of roof 46. Cross rails 54 are elongate along the width 50 of air handler 12 but do not necessarily extend the full width. Cross rails 54 are shown running perpendicular to length 48; however, rails 54 could also lie at some other angle. Each rail 54 includes a lead-in flange 56 that lies at an incline to help guide roof 46 onto a component. Referring to FIGS. 3 and 4, for instance, a first cross rail 54*a* with a first lead-in flange 56*a* and a second cross rail 54*b* with a second lead-in flange 56*b* help align block-off extension 20' of evaporator 20 between rails 54*a* and 54*b*. Upon lowering roof 46 into position, a relatively thick foam gasket 58 becomes compressed between block-off extension 20' and the underside of roof 46. In some cases, gasket 58 has an uncompressed thickness 60 (FIG. 5) of about one inch.

Figure 5:
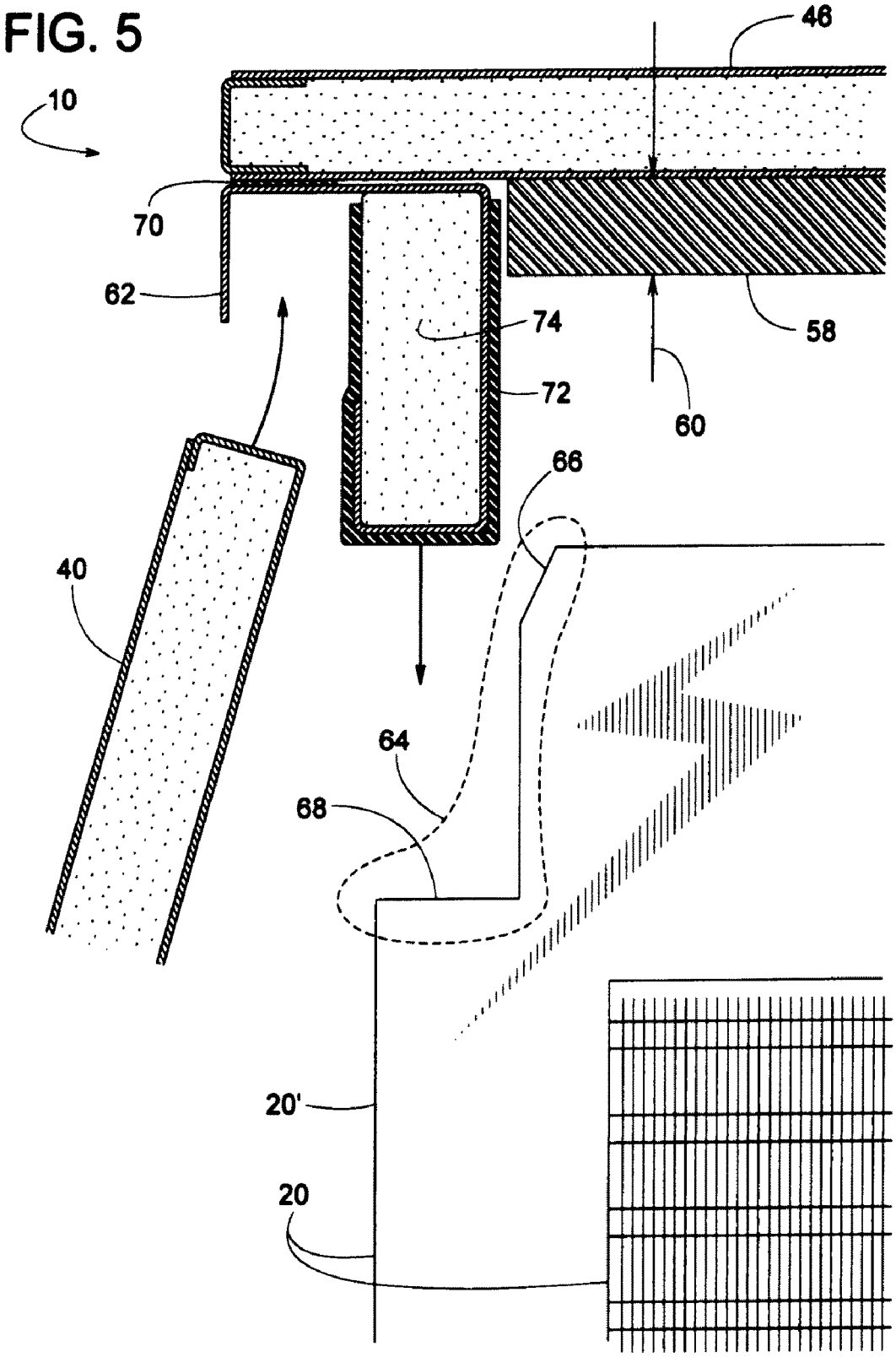
FIG. 5 is a cross-sectional view taken along line 5-5 of FIG. 1.
Figure 6:
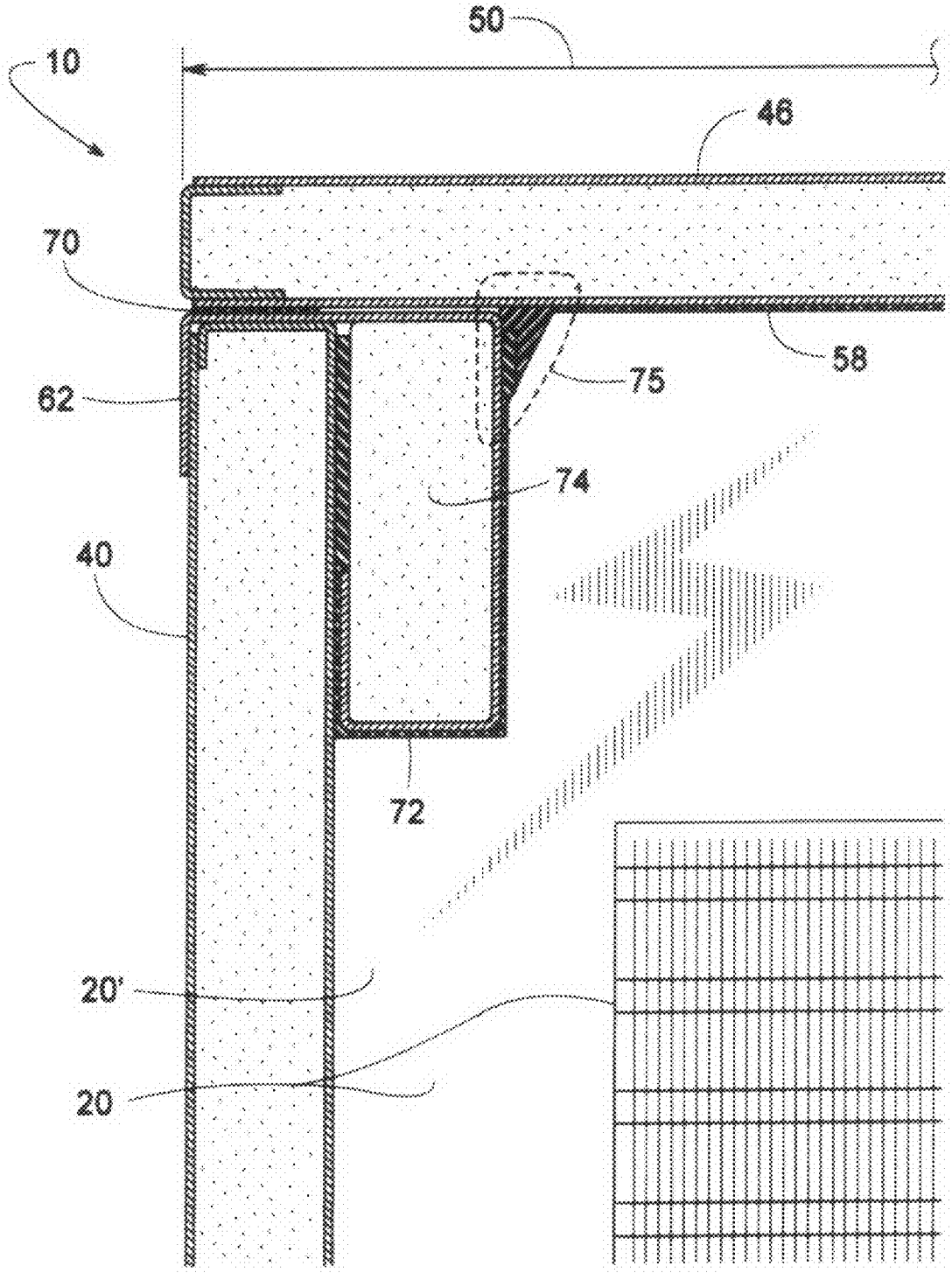
FIG. 6 is a cross-sectional view taken along line 6-6 of FIG. 2.

To assist alignment in a direction parallel to width 50, each internal panel or block-off includes a pair of upper corners that are beveled to help guide a roof rail 62 of roof 46 into position. In FIGS. 5 and 6, for instance, block-off extension 20' of evaporator 20 includes an upper corner 64 with a lead-in edge 66 and a preferably horizontal landing edge 68. Roof rail 62 can run partially or fully along length 48 and is fastened to the underside of roof 46 with a gasket 70 between rail 62 and roof 46. As roof 46 is lowered onto the internal components within enclosure 36, lead-in edge 66 helps guide roof rail 62 into position. When completely lowered, rail 62 is just above landing edge 68, and roof 46 is just above the upper edge of the evaporator's block-off extension 20'. Gasket 58, which has sufficient uncompressed thickness, helps fill a generally triangular gap 75 defined by lead-in edge 66, the inward facing surface of roof rail 62, and the underside of roof 46. Another gasket 72 can provide a seal between roof rail 62 and upper corner 64 of block-off 20'. Gasket 72 can also provide a seal between side panel 40 and roof rail 62. A short filler block 74 can help support gasket 72 and close off a central opening that might otherwise exists within roof rail 62.

Although the invention is described with respect to a preferred embodiment, modifications thereto will be apparent to those of ordinary skill in the art. The scope of the invention, therefore, is to be determined by reference to the following claims:

The invention claimed is:

1. An air handler having a length, width and a height, the air handler comprising:

a heat exchanger containing a fluid;

an internal panel extending along the width of the air handler, the internal panel includes an upper corner having a landing edge and a lead-in edge, wherein the landing edge extends horizontally and the lead-in edge is at an incline;

a roof rail running along the length of the air handler and being above the landing edge of the internal panel;

a side panel underneath the roof rail and adjacent the internal panel;

a roof above the side panel, above the heat exchanger, and being supported by the side panel and the roof rail;

a gap at the upper corner of the internal panel, the gap is defined by the lead-in edge of the internal panel, the roof rail, and the roof; and a gasket that at least partially fills the gap.

2. The air handler of claim 1, wherein the gasket is compressed between the roof and the internal panel.

3. The air handler of claim 1, wherein the gap is generally triangular.

4. The air handler of claim 1, wherein the internal panel is a block-off extension of the evaporator.

5. The air handler of claim 1, further comprising a filter rack underneath the roof, wherein the internal panel is a block-off extension of the filter rack.

6. The air handler of claim 1, further comprising a damper underneath the roof, wherein the internal panel is a block-off extension of the damper.

7. The air handler of claim 1, further comprising a fan underneath the roof, wherein the internal panel is a block-off extension of the fan.

8. The air handler of claim 1, further comprising:

a first cross rail attached to the roof and being elongate along the width of the air handler, the first cross rail includes a first lead-in flange that lies at an incline; and a second cross rail attached to the roof and being elongate along the width of the air handler, the second cross rail includes a second lead-in flange that lies at an incline, the internal panel is interposed between the first cross rail and the second cross rail, the first lead-in flange and the second lead-in flange flare away from the internal panel.

9. The air handler of claim 8, further comprising a gasket between the first cross rail and the second cross rail and being compressed between the roof and the internal panel.

10. The air handler of claim 9, wherein the gasket substantially fills the gap.

11. The air handler of claim 1, wherein the landing edge is substantially horizontal.

12. An air handler having a length, width and a height, the air handler comprising:

a heat exchanger containing a fluid;

an internal panel extending along the width of the air handler, the internal panel includes an upper corner;

a roof rail running along the length of the air handler and being adjacent the upper corner of the internal panel;

a side panel underneath the roof rail and adjacent the internal panel;

a roof above the side panel, above the heat exchanger, and being supported by the side panel and the roof rail;

a first cross rail attached to the roof and being elongate along the width of the air handler, the first cross rail includes a first lead-in flange that lies at an incline; and a second cross rail attached to the roof and being elongate along the width of the air handler, the second cross rail includes a second lead-in flange that lies at an incline, the internal panel is interposed between the first cross rail and the second cross rail, the first lead-in flange and the second lead-in flange flare away from the internal panel.

13. The air handler of claim 12, wherein the internal panel is a block-off extension of the evaporator.

14. The air handler of claim 12, further comprising a filter rack underneath the roof, wherein the internal panel is a block-off extension of the filter rack.

15. The air handler of claim 12, further comprising a damper underneath the roof, wherein the internal panel is a block-off extension of the damper.

16. The air handler of claim 12, further comprising a fan underneath the roof, wherein the internal panel is a block-off extension of the fan.

17. The air handler of claim 16, further comprising a gasket between the first cross rail and the second cross rail and being compressed between the roof and the internal panel.

18. An air handler having a length, width and a height, the air handler comprising:

a heat exchanger containing a fluid;

a fan forcing air through the heat exchanger;

an internal panel extending along the width of the air handler, the internal panel includes an upper corner having a landing edge and a lead-in edge, wherein the landing edge extends horizontally and the lead-in edge is at an incline;

a roof rail running along the length of the air handler and being above the landing edge of the internal panel;

a side panel underneath the roof rail and adjacent the internal panel;

a roof above the side panel, above the heat exchanger, and being supported by the side panel and the roof rail;

a gap at the upper corner of the internal panel, the gap is defined by the lead-in edge of the internal panel, the roof rail, and the roof;

a gasket that at least partially fills the gap;

a first cross rail attached to the roof and being elongate along the width of the air handler, the first cross rail includes a first lead-in flange that lies at an incline; and a second cross rail attached to the roof and being elongate along the width of the air handler, the second cross rail includes a second lead-in flange that lies at an incline, the internal panel is interposed between the first cross rail and the second cross rail, the first lead-in flange and the second lead-in flange flare away from the internal panel.

19. The air handler of claim 18, wherein the gasket is compressed between the roof and the internal panel.

20. The air handler of claim 18, wherein the gap is generally triangular.

21. The air handler of claim 18, wherein the internal panel is a block-off extension of the evaporator.

22. The air handler of claim 18, further comprising a filter rack underneath the roof, wherein the internal panel is a block-off extension of the filter rack.

23. The air handler of claim 18, further comprising a damper underneath the roof, wherein the internal panel is a block-off extension of the damper.

24. The air handler of claim 18, wherein the internal panel is a block-off extension of the fan.

25. The air handler of claim 18, wherein the gasket that at least partially fills the gap also extends between the first cross rail and the second cross rail and is compressed between the roof and the internal panel.

26. The air handler of claim 18, wherein the landing edge is substantially horizontal.

* * * * *